United States Patent [19]

MacMaster et al.

[11] 4,434,387

[45] Feb. 28, 1984

[54] DC ISOLATED RF TRANSITION FOR CATHODE-DRIVEN CROSSED-FIELD AMPLIFIER

[75] Inventors: George H. MacMaster, Lexington; Lawrence J. Nichols, Burlington, both of Mass.

[73] Assignee: Raytheon Company, Lexington, Mass.

[21] Appl. No.: 280,406

[22] Filed: Jul. 6, 1981

[51] Int. Cl.[3] ..... H01J 25/34

[52] U.S. Cl. ..... 315/39.3; 315/39; 333/230

[58] Field of Search ..... 333/230; 315/39, 39.3

[56] References Cited

U.S. PATENT DOCUMENTS

| | | | |
|---|---|---|---|
| 2,948,858 | 8/1960 | Stameson | 315/39 |
| 3,076,115 | 1/1963 | Smith | 313/157 |
| 3,158,779 | 11/1964 | Ayaki | 315/39.3 |
| 3,273,011 | 9/1966 | Brown | 315/39 |
| 3,304,463 | 2/1967 | Wilbur et al. | 315/39 |
| 3,305,751 | 2/1967 | Brown | 315/34 |
| 3,312,859 | 4/1967 | Wilbur et al. | 315/39 |

*Primary Examiner*—Saxfield Chatmon

*Attorney, Agent, or Firm*—Martin M. Santa; Richard M. Sharkansky; Joseph D. Pannone

[57] ABSTRACT

A crossed-field amplifier tube with a cathode slow wave structure at a high electrical potential is coupled to a high frequency of source and a load by a direct current isolated radio frequency transition. The transition is contained within the vacuum of the tube to prevent electrical breakdown between the transition and ground.

8 Claims, 3 Drawing Figures

DC ISOLATED RF TRANSITION FOR CATHODE-DRIVEN CROSSED-FIELD AMPLIFIER

BACKGROUND OF THE INVENTION

This invention relates to crossed-field amplifiers and more particularly to cathode-driven crossed-field amplifiers.

In the cathode-driven crossed-field the cathode is formed to provide a periodic structure which acts as a source of an emitter of electrons and as a support for RF drive energy traveling at a prescribed angular velocity around the cathode structure. The RF drive energy is introduced into the cathode slow wave structure by a transition which allows RF energy to be introduced into the cathode at ground potential while allowing the cathodes to be at a high direct current voltage with respect to ground.

Referring now to FIG. 1, a cross-sectional view of the DC block of the prior art which provided a transition from Rf energy ground potential to the RF energy on the CFA cathode at high negative potential. The transition shown in FIG. 1 is a coaxial line tranmission wherein the coaxial line portion 10 is shown as terminated prior to being connected to the CFA cathode slow wave structure. The transmission line section 10 is composed of an outer conductor 11, an inner conductor 12 and a window 13 typically a ceramic window. The window 13 is hermetically sealed to the outer and inner conductors 11, 12 to allow the region 14 which communicates with the interior of the CFA tube to be in a vacuum whereas the region 15 on the other side of the seal 13 is exposed to the atmosphere. A glass member 16 electrically isolates the coaxial line 10 which is at the high negative cathode potential from the transmission line 17 which desirably is at ground potential. Glass member 16 is shaped to accommodate the inner and outer conductors of both coaxial lines 10 and 17. The inner most portion of glass member 16 has a metallic lining 19 which is in electrical contact with the center conductor 12 having a bulbless springed end 20, the inner conductor 21 of coaxial line 17 has a slotted metallic extension 22 which slips over the inner most portion 23 of glass member 16. Metallic section 22 overlaps the metallic coating 19 by a quarter wavelenght of the designed frequency for the transition. The outer conductors 11 and 18 overlap in a similar manner in order to provide a virtual short between the conductors to cause the two transmission lines 10 and 17 to be effectively coupled with respect to alternating frequency but to be direct current isolated by the glass member 16. The remainder of transmission line 17 is a conventional coaxial line with a stub support 24 and a ceramic 25 centering piece for the inner conductor 21. Coupling to an external transmission line 26 is made through coupler 27 in a conventional manner.

The prior art DC block illustrated in FIG. 1 has the disadvantage that an arc over of the high DC voltage which exists on the cathode either from the outer conductor or the inner conductor of the coaxial line 10 to the corresponding conductors of the coaxial line 11 will cause coaxial line 17 to be at an elevated voltage even though coaxial conductor may be grounded as indicated by ground connection 28 because of the resistance to ground and the large current capacity of the power supply that provides the high negative voltage to the crossed-field amplifier cathode. Even more serious is the possibility of an arc over when through inadvertents or otherwise there is no ground connection 28 at which an operator making a connection of the transmission line 26 to the crossed-field amplifier transmission line 17 would be subjected to the high voltage of the cathode. Thus, the prior art DC block subjects the operator to the possibility of lethal voltage potentials because of arc over across the insulating material 16. Because of the construction of the crossed-field amplifier the insulator material 16 is exposed to the atmosphere and is not under vacuum and hence arc over may be precipitated by atmospheric moisture or contaminants surrounding or deposited on the insulator 16.

It is therefore a primary object of this invention to provide a DC block which does not have the disadvantages of the prior art block. More specifically, the DC block of this invention has as an object the providing of DC voltage isolation independent of the atmospheric conditions attendant upon the operation of the tube. It is a further object of this invention to provide a DC block which is safer from an operators standpoint. It is a still further object of the invention to provide a DC block which is more rugged than the prior art DC block and has more tolerance to shock or mishandling of the tube.

It is a feature of this invention that these and other objects are achieved in this invention by providing a structure in which the direct current isolating coupler is contained within a vacuum thereby rendering it immune to atmospheric conditions which may degrade its performance.

BRIEF DESCRIPTION OF THE DRAWINGS

The foregoing objects and other features of the invention are explained in the following description taken in conjunction with the accompanying drawings wherein.

DESCRIPTION OF THE PREFERRED EMBODIMENT

Figure 1:
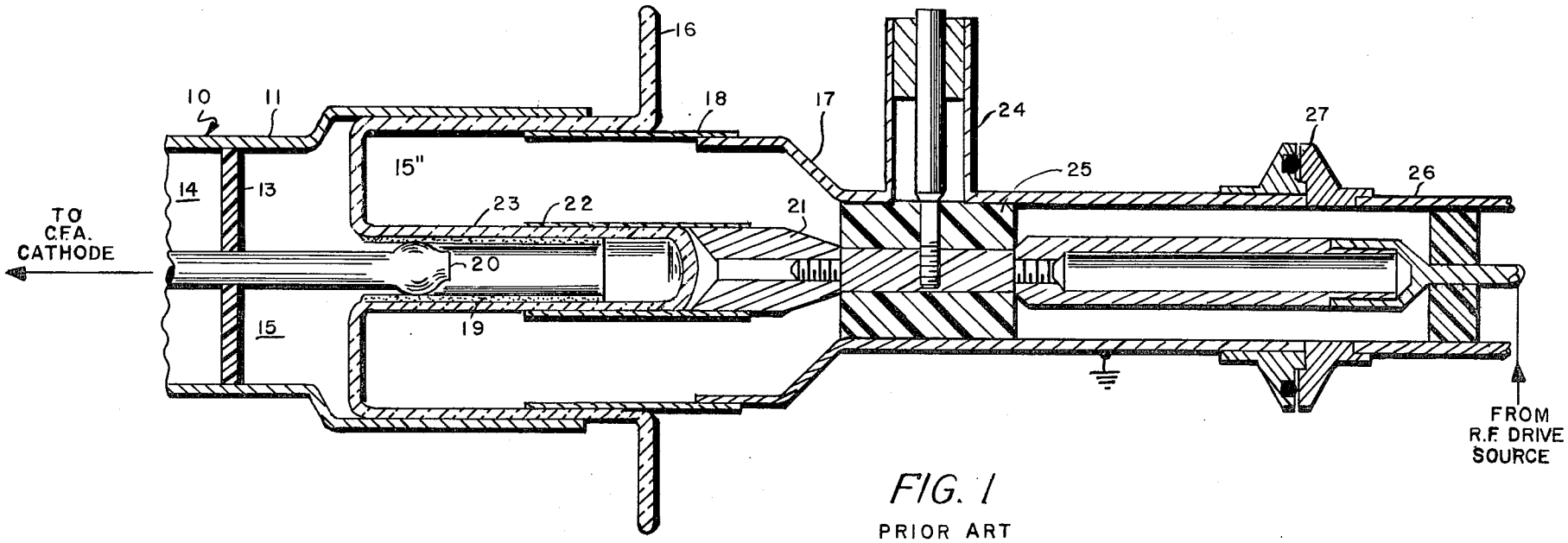
FIG. 1 PRIOR ART
FIG. 1 is a cross-sectional view of a prior art structure for coaxially coupling radio frequency energy to the cathode of a cross-field amplifier tube.
Figure 2:
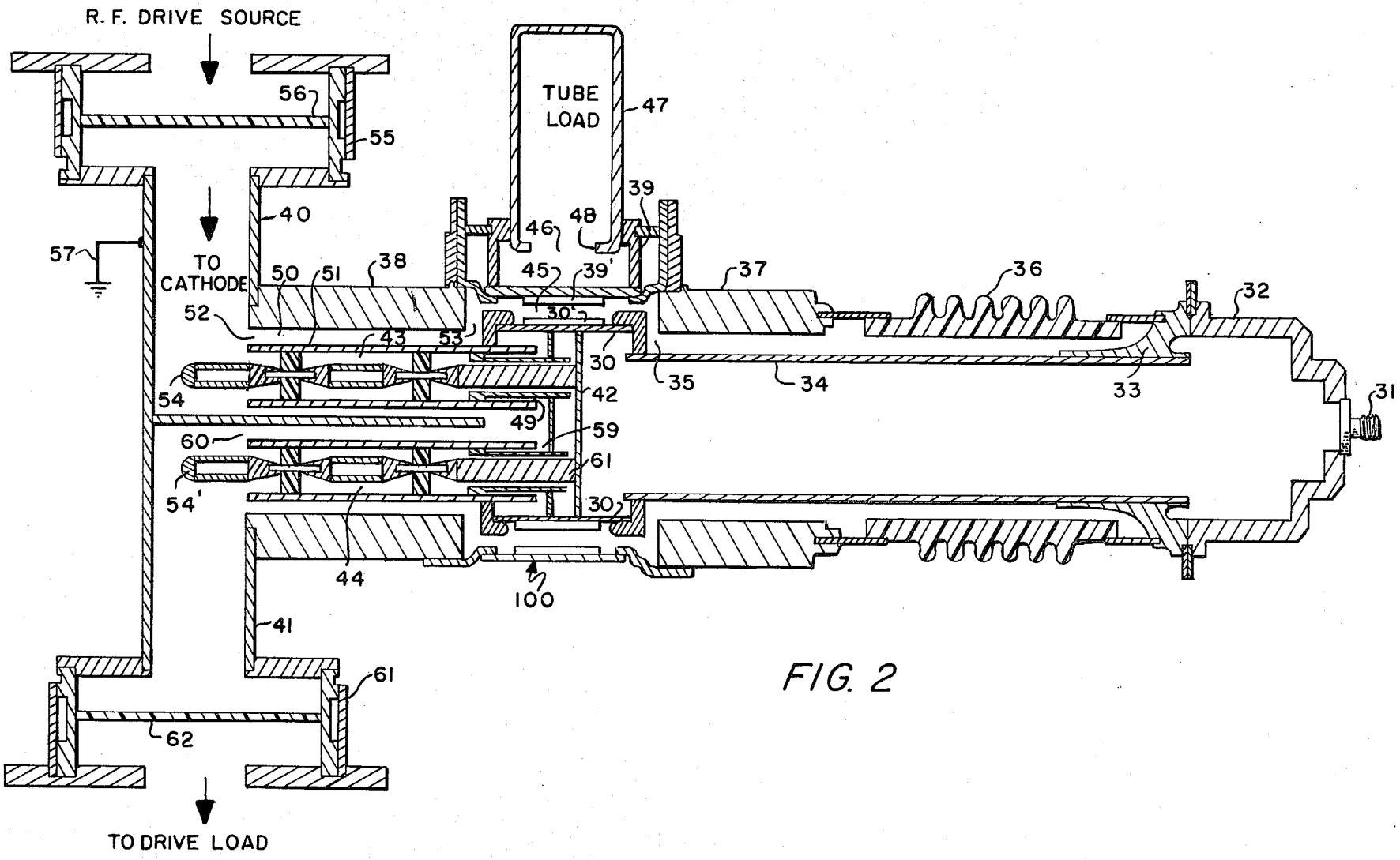
FIG. 2 is a cross-sectional view of one embodiment of the coupler of this invention.

Referring now to FIG. 2 there is shown a cross-sectional view of the DC block for providing RF energy to the cathode structure of a crossed-field amplifier. The crossed-field amplifier comprises a cathode slow wave structure 30 which is electrically connected to a terminal 31 by electrical conductors 32, 33, 34 and 35, in operation the terminal 31 is connected to a source of high negative potential. A ceramic insulator 36 prevents arc over to the iron pole piece 37 which in operation of the crossed-field amplifier is at ground potential as indicated at ground 38. The anode structure 39 is electrically connected to pole piece 37 and 38, pole piece 38 is also connected to the cathode RF feed guide 40 and the cathode output waveguide 41. The cathode structure comprises a strap 42 which is utilized to make electrical connection between the cathode slow wave structure 30 and the input transmission line 43 and the output transmission line 44. The cathode slow wave structure 30 has cathode vanes 30' extending radially outwardly from the cathode slow wave structure and separated by an interaction space 45 from the anode vanes 39' of the anode slow wave structure 39. The anode cavity 46 is connected to the anode output line 47 through an inner connecting aperture 48.

The cathode slow wave structure 30 is connected by a strap 42 to the input transmission line 43. A choke 49 prevents energy propagation along the exterior of transmission line 43. Similarly the coaxial choke 50 which surrounds the outer conductor 51 of transmission line 43 is of the appropriate length at the operating frequency of the crossed-field amplifier to provide at its openings 52, 53 a virtual short circuit by providing a line which is substantially three-quarters of a wavelength in length between the opening 52 and the gap 53 at ends of the coaxial choke 50. Since a virtual short exists at opening 52 of choke 50 no substantial energy will enter choke 50. The transmission line 43 has its center conductor 54 extend into the input waveguide 40 and that portion of the center conductor acts as an electromagnetic probe for extracting energy present in waveguide 40 and causing this energy to propagate down transmission line 43 to provide excitation energy to the cathode slow wave structure 30. The waveguide 40 is terminated in a wavelength coupler 55 for coupling to an RF cathode drive source (not shown). The coupler 55 contains a microwave window 56 which provides a vacuum seal between the atmosphere and the interior of the waveguide 40. Thus, the waveguide 40 which is grounded at ground 57 has the transmission line 43 with its probe 54 at the high negative cathode potential isolated from ground potential within the vacuum of the crossed-field amplifier tube 100.

A second transmission line 44 constructed with chokes 59 and 60 is electrically connected by its center conductor 61 to the output end of the cathode slow wave structure 30. The center conductor of the transmission line 44 extends into a waveguide 41 and forms a probe 54' for exciting electromagnetic energy into the waveguide 41. Waveguide 41 is connected by means of waveguide flange 61 to a cathode load (not shown) for termination of the RF cathode drive source. The RF drive energy from the cathode 30 passes through the output window 62 which provides a vacuum seal between the interior of the waveguide 41 and the atmosphere. Thus, transmission line 44 is also within a vacuum. Waveguides 40 and 41 are shown rotated through ninety space degrees in FIG. 2 from this actual orientation in order to more clearly present the invention.

It is thus seen that with the DC block structure of this preferred embodiment of the invention that the high negative potential of the cathode is always isolated from ground within a vacuum and hence is not subject to contamination or other properties produced by the atmosphere which might cause breakdown between the transmission lines connected to the cathode and the ground.

Figure 3:
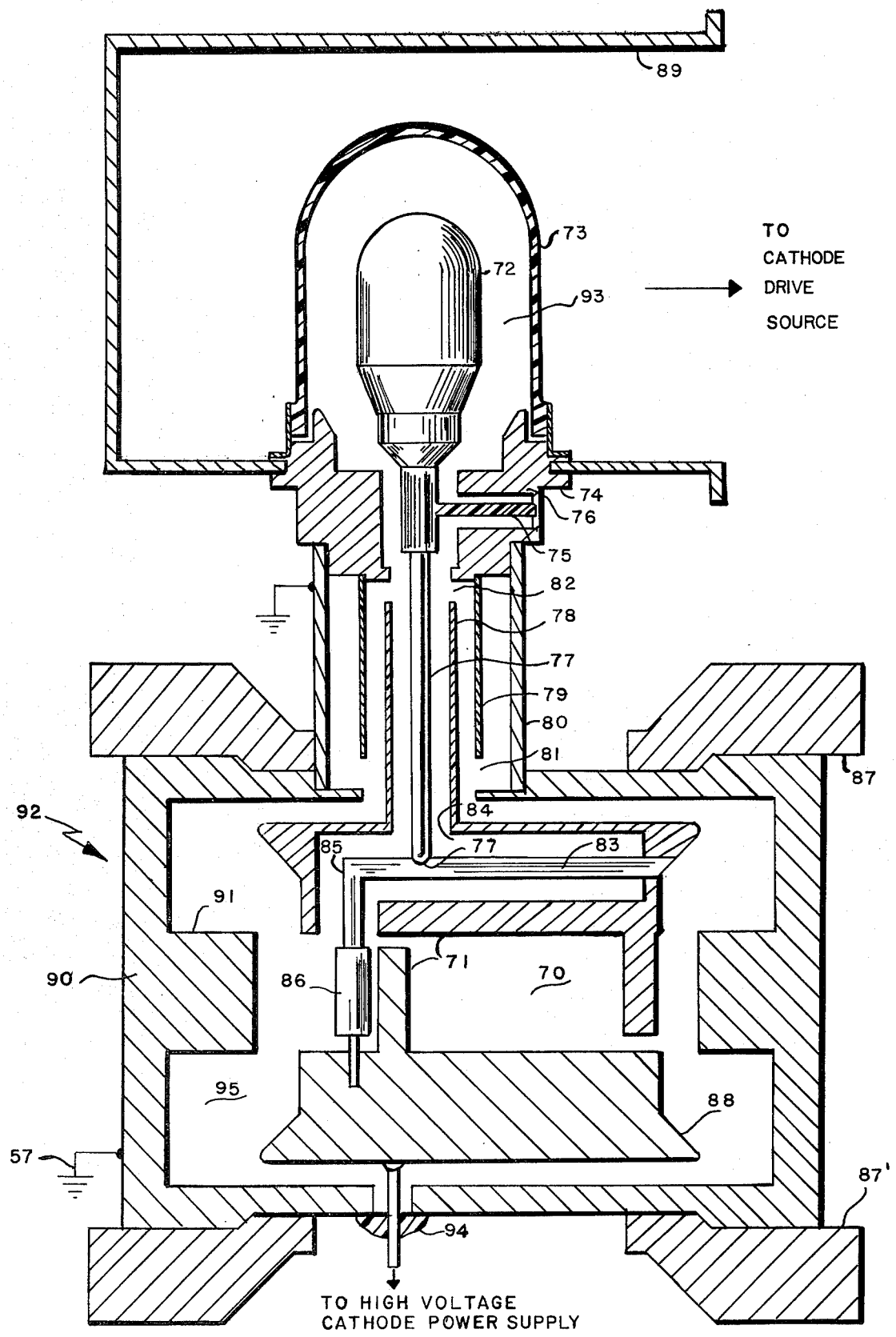
FIG. 3 is a cross-sectional view of another embodiment of the coupler of this invention.

An alternate embodiment of the invention is shown in cross-section in FIG. 3 wherein an anode 90 with its slow wave structure 91 is coupled to the cathode portion 70 including its cathode slow wave structure 71 of the crossed-field amplifier 92 is shown. The waveguide coupler 69, through which a microwave cathode drive frequency source (not shown) is connected to the cathode structure 71, contains a probe 72 enclosed within a ceramic housing 73 which provides a vacuum tight envelope 93 in conjunction with other components within which the probe 72 is confined. Ceramic housing 73 is secured to a metallic support member 74 to which attachment is made to the waveguide coupling section 89. The probe 72 is supported by a dielectric support post 75 which is attached an one end 76 to grounded metal outer conductor 74. The probe 72 is continued as a center conductor 77 of a coaxial line also comprised of a concentric cylindrical conductive line 78. The r.f. drive energy is contained within the coaxial line comprised of center conductor 77 and its surrounding coaxial conductor 78. The concentric conductors 78, 79, 80 form quarter wavelength rf chokes. The high impedance at the input 81 of the choke comprised of conductors 79, 80 is transformed to a low impedance at the input 82 of the choke formed by conductors 78, 79. Thus, the energy traveling between the center conductor 77 and its surrounding concentric conductors 76 and 78 is confined within the coaxial conductor thus formed. The end 771 of center conductor 77 is supported by a quarter wavelength stub 83 which provides a high impedance at its input 84 thereby causing the drive radio frequency to be transmitted along the transmission line 85 to a load 86 which is capacitively coupled to the cathode slow wave structure 71 to thereby couple the drive rf energy from the source into the cathode slow wave structure. The choke arrangement of concentric conductors 78–80 provides a coaxial line transition whereby the grounded outer line 79 is interrupted and continues as outer line 78 at a high negative potential without significant mismatch in the transmission line comprised of concentric conductors 77, 78.

The conventional anode slow wave structure 91 is electrically connected to ground as are the magnetic field pole pieces 87. The high negative potential at which the cathode operates in FIG. 3 is applied through a structure similar to structure 32, 36 of FIG. 2, but not shown in FIG. 3, to the cathode end cap 88 from when it is electrically connected to the cathode structure 70.

It should be noted that the inner coaxial line comprised of lines 77 and 78 are at high negative potential and are isolated from the grounded conductors 79, 80 by the choke sections which are contained within the vacuum of the tube and hence are not susceptible to voltage breakdown because of atmospheric conditions. The vacuum region 95 of the tube 92 communicates with the vacuum 93 within housing 73 so that the probe 72 is also in a vacuum and is therefore not susceptible to voltage breakdown.

Having described a preferred embodiment of the invention it will now be apparent to one of skill in the art that other embodiments incorporating its concept may be used. It is believed therefore that this invention should not be restricted to the disclosed embodiment but rather should be limited only by the spirit and scope of the appended claims.

What is claimed is:

1. A radio frequency coupler for coupling to the cathode of a tube comprising:

a tube having a cathode comprising a slow wave structure;

means for coupling radio frequency energy into said cathode slow wave structure;

said coupling means comprising a waveguide and a radio frequency probe inserted into said waveguide;

means directly connecting electrically said probe to said cathode so that said probe is at the same direct-current potential as said cathode, said connecting means comprising the center conductor of a coaxial transmission line, said transmission line comprised of a first and second outer conductor coaxial with said center conductor, said first outer conductor being at ground potential, said second outer conductor being directly connected to said cathode and at said cathode potential, a radio frequency choke comprised of said first and second outer conductors electrically connecting said first and second outer conductors to each other by a low impedance at said radio frequency;

a vacuum chamber means containing said probe, said probe connecting means, and said cathode;

said probe being electrically isolated from said waveguide to withstand a direct-current voltage applied through said cathode to said probe.

2. The coupler of claim 1 wherein said coupling means comprises:

a coaxial transmission line comprising a center line directly electrically connected between said probe and said cathode;

said transmission line also comprising an outer circular line concentric with said center line, said outer line being electrically connected to said cathode;

the space between said inner and outer lines providing a transmission path for radio frequency energy between said probe and said cathode;

an outermost electrical conductor coaxial with said outer conductor and electrically isolated therefrom to withstand, without electrical breakdown, a voltage gradient between said outer and outermost conductors produced by electrical connection of said cathode to a high direct current voltage.

3. The coupling of claim 2 wherein said outer coaxial line has a concentric choke at its end which is connected to said cathode to provide a high impedance along the exterior of said outer coaxial line to prevent the propagation of radio frequency energy along the exterior surface of said outer coaxial line towards said probe.

4. The coupling of claim 2 wherein said outer and outermost lines coaxially spaced from each other form a coaxial line and the length of said lines is selected to provide a choke to prevent the propagation of radio frequency energy along said space between said outer and outermost lines.

5. The coupling of claim 1 comprising in addition a vacuum seal connected to said waveguide, said seal separating the portion of said waveguide containing said probe from the surrounding atmosphere to provide a vacuum chamber of said vacuum chamber means within said waveguide containing said probe.

6. The coupling of claim 1 wherein said vacuum chamber means comprises a housing which is transmissive of radio frequency energy, said housing surrounding said probe and sealed to said waveguide containing said probe to provide a vacuum space between said probe and said housing, said vacuum space forming a portion of said vacuum chamber means.

7. A direct-current-isolated radio frequency coupler in a cathode-driven crossed-field amplifier tube comprising:

a waveguide;

a radio frequency probe in said waveguide;

means for electrically connecting said probe to the cathode of said tube;

said electrical connecting means comprises a coaxial transmission line comprising a center line, an outer line, and an outermost line, both concentric with said center line;

said probe being connected to the center line of said coaxial line;

said outer conductor of said coaxial line being directly electrically connected to said cathode and forming with said center line a coaxial line for transmission of radio frequency energy between said cathode and said probe;

said outermost line being electrically isolated from said outer line and forming a choke therewith to prevent radio frequency energy from entering the coaxial lines formed by said center, outer, and outermost lines;

a vacuum chamber containing the coaxial lines formed by said outer and outermost lines;

said outer and outermost lines being spaced by a sufficient distance to prevent electrical breakdown between said lines within said vacuum chamber when a direct current voltage is applied to said cathode, said outermost line being at ground potential;

a vacuum seal for said waveguide to provide a vacuum chamber is said waveguide connected to the vacuum space of said tube;

said probe and connecting means being contained within said vacuum chamber;

whereby radio frequency energy in said waveguide is transferred by said probe and connecting means to said cathode.

8. The coupler of claim 7 wherein said electrical connecting means connects said probe directly to said cathode so that said probe is at the same direct-current potential as said cathode.

* * * * *